United States Patent [19]

Chen

[11] Patent Number: 4,583,993

[45] Date of Patent: Apr. 22, 1986

[54] PROCESS FOR THE PRODUCTION OF CARBON MONOXIDE AND HYDROGEN FROM CARBONACEOUS MATERIAL

[75] Inventor: Nai Y. Chen, Titusville, N.J.

[73] Assignee: Mobil Oil Corporation, New York, N.Y.

[21] Appl. No.: 305,675

[22] Filed: Sep. 25, 1981

Related U.S. Application Data

[63] Continuation of Ser. No. 918,972, Jun. 26, 1978, abandoned, said Ser. No. 918,972, is a continuation of Ser. No. 791,765, Apr. 28, 1977, abandoned.

[51] Int. Cl.[4] ..... C10J 3/54

[52] U.S. Cl. ..... 48/197 R; 48/210; 423/415 A; 423/655

[58] Field of Search ..... 48/197 R, 210, 211; 423/415 A, 655, 656; 252/373; 208/8 E, 11 E, 127; 48/211; 201/31

[56] References Cited

U.S. PATENT DOCUMENTS

| | | | |
|---|---|---|---|
| 3,226,316 | 12/1965 | Metrailer et al. | 208/127 |
| 3,617,513 | 11/1971 | Wilson et al. | 208/127 |
| 3,692,506 | 9/1972 | Johnson | 48/210 |
| 3,726,784 | 4/1973 | Correa et al. | 208/8 |
| 3,976,442 | 8/1976 | Paull | 48/197 R |
| 4,040,976 | 8/1977 | Greene | 252/373 |

*Primary Examiner*—Peter Kratz

*Attorney, Agent, or Firm*—Alexander J. McKillop; Michael G. Gilman; Howard M. Flournoy

[57] ABSTRACT

Hydrogen and carbon monoxide are produced from coal, char or other carbonaceous material in a processing combination comprising a catalytic CO generator employing as reactant materials, fluid carbon material and $CO_2$ product of the reaction of steam with CO to produce hydrogen and $CO_2$. $CO_2$ produced in the process is relied upon as the primary endothermic heat source in the fluid CO generator.

4 Claims, 1 Drawing Figure

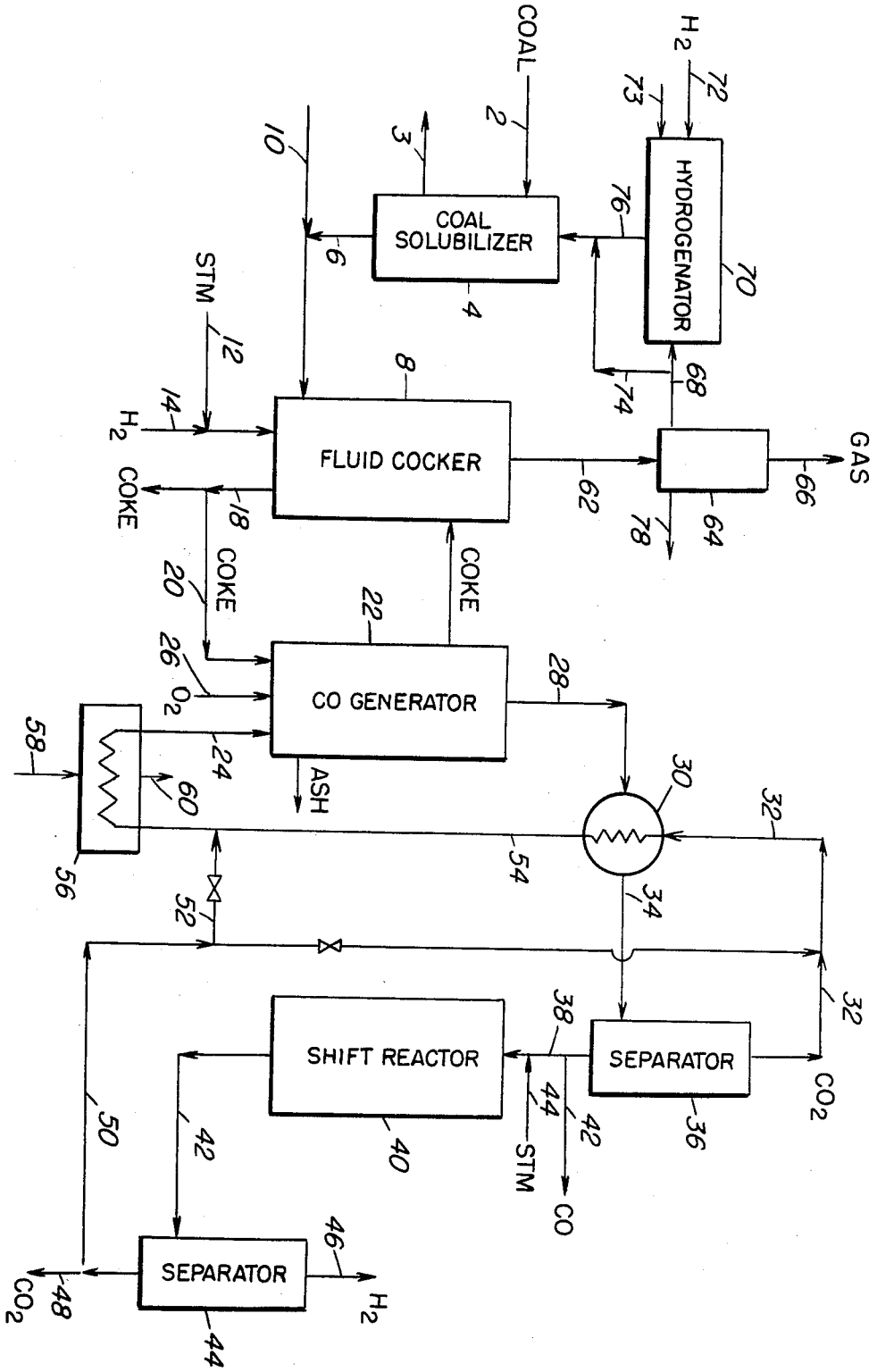
COAL
2
3
10
COAL SOLUBILIZER
4
6
$H_2$
72
73
HYDROGENATOR
70
76
68
74
STM
12
14
$H_2$
8
FLUID COCKER
COKE
18
62
64
66
78
GAS
COKE
20
COKE
22
26
$O_2$
CO GENERATOR
28
58
24
60
ASH
56
54
30
32
52
34
SHIFT REACTOR
38
SEPARATOR
36
$CO_2$
50
42
40
44
STM
42
CO
SEPARATOR
46
$H_2$
48
$CO_2$
44

PROCESS FOR THE PRODUCTION OF CARBON MONOXIDE AND HYDROGEN FROM CARBONACEOUS MATERIAL

RELATED U.S. APPLICATIONS

This application is a continuing application of Ser. No. 918,972, filed June 26, 1978 and now abandoned, which application Ser. No. 918,972 is a continuing application of Ser. No. 791,765, filed Apr. 28, 1977 and now abandoned.

BACKGROUND OF THE INVENTION

The conversion of coal to gaseous products of low and higher heating value has been pursued by many technologists over the years. However, coal, because of contaminating metal components, sulfur and nitrogen in the gaseous conversion products, has been regarded by many as a dirty fuel. Removal of sulfur and nitrogen from product gases is costly for which there has yet been no satisfactory economic solution. The conversion of coal has pursued three basic routes involving the production of low BTU heating value gas, medium or high BTU heating value gas; the thermal production of oil from coal which is then treated with hydrogen to remove sulfur from the oil and improve the oil quality; and thirdly, the solvation of coal with the filtering out of ash and pyretic sulfur.

The present invention is concerned with producing a clean gas composition of hydrogen and carbon monoxide from coal which is free of sulfur and nitrogen. A further object of this invention is to produce separate streams of hydrogen and carbon monoxide which can be blended to form any desired ratio thereof for syngas conversion with a Fischer-Tropsch synthesis containing catalysts. Other objects and advantages of the present invention will be more apparent from the following discussion.

SUMMARY OF THE INVENTION

The present invention contemplates an integrated operation comprising one or more steps including solubilizing coal, fluidized coal volatilization, fluid coking, conversion of coke obtained from one or more or a combination of the above to CO and the generation of $CO_2$ employed in said CO generator by use of the well known water gas shift reaction. Hydrogen produced in the process may be used in part to hydrogenate a coal solubilizing liquid passed to the coal solubilizing step. The integrated operation is particularly desirable in utilizing metal contaminated carbonaceous materials which are products of one or more of the herein described operations involving coal, tar sands, residual oils and combinations thereof. Coke and char products of these operations are laden with metals selected from the group consisting of iron, nickel, vanadium and copper. The metals, iron and nickel, are particularly desirable for promoting the reactions herein particularly desired. Thus the build-up of metals, iron and nickel, on the coke particles circulated from the fluid coker to the CO generator and back to the fluid coker is not an undesirable expedient on the overall combination.

In the fluid coking step or fluid coal volatilization step as herein identified of the combination operation, a portion of the endothermic heat required in the operation is supplied to the fluid coking step by circulating a portion of hot coke solids obtained from a CO generator to the fluid coker. Generally, these solids will be at a temperature within the range of 1350° to 2400° F. On the other hand, a separate coke burner may be employed alone or in combination with the CO generator to prvide hot coke particles heated to a desired elevated temperature by partial burning with air, for example, and the coke particles thus heated are recycled to the fluid coking step. The fluid coking step or coal volatilization operation employed is normally maintained at a temperature within the range of about 1000° F. to 1600° F.

The present invention particularly contemplates processing char or coke residue particles obtained as herein defined by contacting the coke particles with $CO_2$ in the presence of a reducing catalyst to produce a (CO) carbon monoxide rich gaseous product stream. In this CO producing operation, a fluid coke particle system is preferably employed for effecting the desired highly endothermic reaction in the presence of ($CO_2$) carbon dioxide heated to an elevated temperature as herein described. The primary source of $CO_2$ used in the combination operation of this invention is that recovered from a shift reactor system comprising the reaction of carbon monoxide (CO) with water (steam). Catalytic materials particularly promoting the reaction of carbon dioxide ($CO_2$) with carbon particles are those comprising metals selected from Group VIII of the Periodic Table impregnated in the coke particles or on separate carrier or support materials charged with the particles of coke. Metal components suitable for this operation include iron, cobalt and nickel. Metal contaminants included in the carbon residue of coal solubilization, tar sands and residual hydrocarbonaceous material may be the primary source of the required catalytic metal component.

The endothermic fluid particle CO generator herein defined is maintained at a temperature within the range of 1350° F. to about 2400° F. but more preferably it is maintained at a temperature within the range of 1500° to 2000° F. The pressure of the CO generator may be within the range of about 1 atmosphere up to about 70 atmospheres and preferably within the range of 2 to 20 atmospheres.

The CO generator relies upon using fluid coke or char particles impregnated with metal contaminants alone or in admixture with a reducing catalyst particle of a particle size in the range of 10 to 100 microns up to about ¼ inch. This fluid coke conversion operation is maintained under conditions selected to particularly maintain the CO concentration in the reactor above about 70 mol. percent. The reaction is controlled essentially by the chemical equilibrium reaction represented by $C+CO_2 \rightarrow 2CO$. When the CO concentration falls below this particularly desired 70% lower limit, the rate of catalytic reduction of $CO_2$ by coke is drastically reduced. Above 70%, the reaction rate is faster than that of the well-known steam-carbon reaction ($C+H_2O \rightarrow CO+H_2$). Therefore, the present invention is directed to a process requiring less severe operating conditions as compared to the known steam-carbon reaction technology. The process of this invention therefore requires lower capital investment and operating costs. In this fluid coke particle conversion operation, as the pressure of the operation is increased, so also is the temperature increased to maintain the chemical equilibrium desired. However, relatively moderate pressures are desirable to minimize processing costs, equipment costs, and particularly high compression costs.

The reaction of coke, char or carbon particles with carbon dioxide in the presence of a catalyst promoter to produce carbon monoxide is highly endothermic, requiring about 40.8 kilocalories per mole of carbon. The heat of reaction may be supplied in part by effecting a partial oxidation with oxygen as opposed to air within the fluid reactor operation. It is believed by some experts in the art that surface oxidation of the coke contributes measurably to the operation. Relatively pure oxygen is preferred for this purpose so that the product gas comprising carbon monoxide and carbon dioxide will not be contaminated with nitrogen as would occur should one use air as the oxygen source. To supply the heat needed by the fluid CO generator with only oxygen will require about 0.3 moles of oxygen for each mole of carbon reacted. However, heat to the fluid coke-CO generator may be supplied in combination with other operating modes, and the oxygen requirement would be correspondingly decreased. Thus superheated $CO_2$ may be used as a heat carrier alone or in combination with oxygen addition. One may also rely upon indirect heat exchange means to preheat reactant materials, and provide heat by circulating catalyst solids from an exothermic coke burning and/or catalyst regeneration zone to the endothermic CO producing zone in a manner similar to that practiced in the fluid cracking art.

The combination process of the present invention includes the use of a water gas shift operation to particularly effect the reaction of carbon monoxide with steam to form carbon dioxide and hydrogen according to the reaction ($CO+H_2O \rightarrow CO_2+H_2$). The water gas shift operation is generally effected at a temperature within the range of 750° to 1000° F. employing a pressure within the range of 50 to 600 psi. This catalytic operation is promoted by catalysts such as iron, cobalt and molybdenum.

The combination operation of this invention contemplates establishing and maintaining a high temperature working relationship between fluid coke or char solids employed in the fluid CO generator and a high temperature, short contact time operation for volatilizing coal to promote the recovery of volatile matter from coal particles and other materials herein identified, thereby producing a high temperature char particle product comprising catalytic metal contaminants which are suitable for providing a portion of the heat in the fluid CO generator. In this combination, a two vessel system is contemplated such as one might employ in a conventional fluid coking process for resids except that the operating pressure and temperature of the present combination will be considerably higher. It is further contemplated effecting the operation in the presence of added hydrogen. Fluid cokers operate at atmospheric or slightly higher pressures generally less than about 100 psig.

In the coal volatilization operation herein contemplated, coal particles of acceptable particle size are maintained in fluid contact with a mixture of steam and hydrogen at a high temperature within the range of about 1000° to 1600° F. and more usually in the range of 1100° to 1300° F. so as to rapidly separate and recover valuable liquid and gaseous hydrocarbons from the coal particles charged. On the other hand, coal particles of acceptable size may be first solubilized in a suitable solvent material such as a liquid product of solvent refined coal or a highly aromatic product of fluid catalytic cracking such as obtained as the main column bottoms of such an operation. The liquid product of coal solvation, a char product of coal solvation, a coal liquid slurry, a hydrocarbonaceous product recovered from tar sands, metal containing residual oils or combinations of one or more of these materials may be charged as feed to the fluid coking operation of the invention. The heavy liquid material charged to the fluid coking operation in combination with an atomizing fluid such as steam, either with or without the presence of added hydrogen is brought in contact with hot coke particles at an elevated temperature above about 1000° F. and more usually at a temperature within the range of about 1100° F. to about 1400° F. thereby producing gaseous and liquid product of the material charged. The liquid product thus produced may be hydrogenated and catalytically upgraded by processes known in the art such as fluid catalytic cracking, hydrocracking, and hydrotreating.

The more elevated the temperature and the shorter the contact time one employs in this fluid coking operation has been found to be effective in increasing the yield of liquid product. A devolatilized coke or char product comprising metal contaminants is recovered from the fluid coking operation at an elevated temperature about 1000° F. and up to about 1300° or 1400° F. The hot coke or char product thus produced may be used as herein defined to accomplishing the processing sequence of the present invention. For example, as suggested herein, the recovered hot coke particles may be charged all or in part to a separate coke burner (not shown) maintained under conditions to burn a portion of the particle coke product and produce carbon dioxide and hot particles of coke referred to as seed coke particles for recycle to the fluid coking operation. On the other hand, a portion of the char or coke particles thus formed in either the fluid coker or the coke burner and comprising metal contaminants may be passed to the CO generator herein discussed. The hot coke or carbon particles produced in the fluid coking step or a portion thereof are passed to the CO generator for contact with a mixture of oxygen and carbon dioxide ($CO_2$) at a temperature within the range of about 1350° F. to about 2400° F. In such an operation, carbon dioxide ($CO_2$) is found in admixture with a significant concentration of carbon monoxide. The carbon monoxide produced in the CO generator may be separated from unconverted $CO_2$ to produce a relatively pure stream of carbon monoxide which is recovered as a product of the process. Separated $CO_2$ is recycled to the CO generator. Also a portion of the CO rich product is passed with steam in contact with a shift catalyst to accomplish the reaction $CO+H_2O \rightarrow CO_2+H_2$ under the conditions briefly discussed above.

In any of the combination of operations herein discussed, it is an object of the combination to produce a stream of carbon, coke or char particles comprising catalytic metal components such as iron and nickel from coal, residual oil, tar sands, and hydrocarbonaceous product of oil shale decomposition or retorting or mixtures thereof. The carbon or coke particle produced is converted to carbon monoxide and a portion of the carbon monoxide (CO) produced is reacted with steam to permit the recovery of hydrogen and carbon dioxide as separate product streams of the process.

BRIEF DESCRIPTION OF THE DRAWING

The drawing is a brief diagram of an embodiment of the invention.

DISCUSSION OF SPECIFIC EMBODIMENT

Referring now to the drawing, which is a diagrammatic showing of the processing combination of the invention wherein for example coal is introduced to the process as the charge material by conduit 2 to a coal solubilizing step in zone 4. In zone 4 solvation of the coal charge is accomplished partially or more completely depending on the solvent employed but with liquid solvent material such as that obtained from coal, referred to as a liquid product of solvent refined coal (SRC) or a high boiling product of cracking crude oil (heavy cycle oil) and having high solvent activity characteristics. The liquid product of the coal solvation step may be partially or completely recovered by conduit 3, or a slurry of coal-char particles and solvent liquid is recovered and passed by conduit 6 to a fluid coking operation effected in zone 8. As mentioned above, the combination of the present invention contemplates processing materials other than coal liquids in the fluid coker. For example, hydrocarbonaceous materials recovered from tar sands, metal containing residual oils or kerogen decomposition product of oil shale may be charged alone or in combination with the coal slurry or product of coal solvation. These hydrocarbonaceous materials may be introduced to the process by conduit 10. On the other hand, conduit 10 may be used to charge supplemental additions of a catalytic metal component such as iron and nickel to the coal liquid slurry passed to the fluid coking zone 8.

In fluid coking zone 8, the coal particle-liquid slurry medium comprising metal catalyst material with or without other materials as provided herein, is contacted under elevated temperature conditions generally at least about 1000° F. with steam introduced by conduit 12 alone or in the presence of hydrogen in conduit 14 and under pressure conditions generally below about 500 psig but above atmospheric pressure. During the elevated temperature fluid coking conditions maintained in zone 8, gaseous and liquid products of the operation are recovered by conduit 62 from the mixture of hydrocarbonaceous materials charged, thereby producing a fluid mass of separate and discrete coke particles comprising metal contaminants such as iron, nickel, vanadium and copper. The fluid particles of coke formed and maintained in a relatively dense fluid condition in zone 8 require substantially continuous replacement of larger size particles with smaller size particles because of the coke lay down in the fluid coking zone. Accordingly, fluid coke particles are substantially continuously removed from zone 8 by conduit 18 for further processing as herein described. A portion of the coke particles thus withdrawn may be passed to a separate partial coke burner not shown for use as discussed above. In a preferred arrangement, a substantial portion of the withdrawn hot coke particles in conduit 18 are passed by conduit 20 to a carbon monoxide (CO) generator 22.

In CO generator 22, the coke particles comprising metal catalyst components such as iron and nickel are brought in contact with preheated carbon dioxide ($CO_2$) introduced by conduit 24 with or without added oxygen in conduit 26 in a dense fluid bed condition to form a gaseous stream rich in carbon monoxide (CO) but containing unreacted $CO_2$. The CO generator consumes coke and produces an ash product requiring separation from coke particles at a high temperature. The coke particles are generally of a smaller particle size than when introduced to the CO generator. The hot particles of coke separated from ash product is preferably recycled at least in part to the fluid coking step taking place in zone 8. Thus a portion of the heat required in the fluid coking step of zone 8 may be supplied all or in part by the coke particles cascaded from the CO generator, from the coke burner discussed above but not shown or by a combination of the two streams.

A carbon monoxide rich gaseous product is recovered from the CO generator by conduit 28 at an elevated temperature within the range of 1300° to 2350° F. The recovered CO rich product stream in conduit 28 is passed through indirect heat exchange means represented by heat exchanger 30 wherein the CO rich product stream is indirectly cooled by recycled $CO_2$ in conduit 32 recovered from a downstream shift reactor system. The CO rich stream is cooled to about 200° F. before passage by conduit 34 to a separator zone 36 wherein a separation is made to recover $CO_2$ from CO. Separation of CO from $Co_2$ may be accomplished by any one of the known processes employing amines, caustic and carbonite materials as the absorbent. $CO_2$ separated in separator 36 is recovered by conduit 32 for recycle as herein provided; separated CO is withdrawn by conduit 38 for passage all or in part to shift reactor 40. When a CO rich product stream is desired, it may be recovered by conduit 42. Steam is introduced to the shift reactor system by conduit 44.

In shift reactor 40 the well known catalytic reaction of CO with steam is exothermic and particularly promoted with a shift catalyst to produce a gaseous product of $CO_2$ and hydrogen. The shift reaction in zone 40 is accomplished at a temperature promoting the reaction desired and within the range of about 750° to about 850° F. A pressure is employed within the range of 50 to 600 psig in the presence of a shift catalyst such as iron, cobalt and nickel. The water gas shift product particularly comprising $CO_2$ and $H_2$ is withdrawn by conduit 42 for passage to a separation zone 44. Separation of the hydrogen product from $CO_2$ in zone 44 may be accomplished by any of the techniques known in the prior art. $CO_2$ absorption-desorption methods employing caustic and amines may be employed for this separation purpose. A hydrogen rich gas is recovered from zone 44 by conduit 46 with the separated $CO_2$ being recovered by conduit 48. In the arrangement of the processing combination of the drawing the $CO_2$ produced and recovered by conduit 48 is passed by conduit 50 for admixture with recovered $CO_2$ in conduit 32 before passage through heat exchange step 30. On the other hand, a portion of the $CO_2$ in conduit 50 may bypass exchanger 30 by conduit 52 for admixture with preheated $CO_2$ in conduit 54 recovered from exchanger 30. The preheated $CO_2$ in conduit 54 is then passed through furnace heater means 56 to which a combustion fuel air mixture is charged by conduit 58. Flue gas is recovered by conduit 60. In furnace 56 the recycled $CO_2$ recovered from the shift reactor and free of nitrogen is further indirectly heated to an elevated temperature suitable for introduction to the CO generator zone 22 by conduit 24. Thus the combination of heat exchange means 30 and furnace heater means 56, indirectly heat the recycled $CO_2$ stream to an elevated temperature so that it is the primary source of endothermic heat required in the CO generation step. Of course as mentioned above, a portion of the heat of reaction in the CO generation step is provided by the coke particles passed thereto and this may be supplemented by the addition of oxygen introduced by conduit 26.

A hydrogen product stream of high purity recovered by conduit 46 may be blended with the high purity CO stream recovered by conduit 42 to produce substantially any desired blend of the two streams. An important factor in this method of generating a syngas stream suitable for use in Fischer-Tropsch type reactions is that the syngas is free of nitrogen and sulfur and the ratio of the two syngas components can be varied as desired.

The fluid coking operation performed in zone 8 is a high temperature thermal conversion operation effected in the presence of steam primarily to disperse the heavy feed material for contact with fluid particles of coke therein. Hydrogen may be added to the operation as desired. A gas and liquid product is recovered from the fluid coker by conduit 62 for passage to a separation zone 64. Separated gaseous material is recovered from separation zone 64 by conduit 66 with the liquid product removed by conduit 68. All or a portion of the liquid product in conduit 68 may be passed to a hydrogenation zone 70 wherein the liquid is catalytically hydrogenated with hydrogen introduced by conduit 72. Catalytic hydrogenation of liquid hydrocarbonaceous material is known in the prior art and such technology may be adapted for use in the hydrogenation operation of zone 70. On the other hand, the recovered liquid in conduit 68 may bypass the hydrogenation step as by conduit 74 for direct passage to the coal solubilizer 4. The hydrogenated liquid product is passed in a desired amount by conduit 76 to the coal solubilizing step. On the other hand, liquid product of the fluid coking operation separated in separator 64 but not charged to the hydrogenation operation or the coal solubilizing operation may be recovered by conduit 78. It also is to be noted that hydrogen product of the shift reaction and recovered by conduit 46 may be charged in part by conduit 72 to the hydrogenation step in zone 70.

In yet another embodiment, it is contemplated modifying the operation to the extent that carbonaceous liquids from outside sources such as heavy cycle oil, syntower bottoms and FCC main column bottoms material may be charged to the hydrogenation zone 70 by conduit 74. This hydrogenated product may then be passed by conduit 76 to zone 4.

The present invention contemplates the blending of the hydrogen and CO produced in the operation and the conversion of the blend to methanol and thence to an olefinic or aromatic product. It also contemplates the conversion of the blend as by Fischer-Tropsch synthesis to produce hydrocarbon products in single or multiple stage operation. More importantly, it contemplates the use of ZSM-5 type crystalline zeolites to convert Fischer-Tropsch syngas conversion products.

I claim:

1. A method for producing separate streams of hydrogen and carbon monoxide of relatively high purity from a char like product selected from the group consisting of coal, char product of coal solvation, char product of coal volatilization, solid decomposition products of tar sands and oil shale comprising carbonaceous material which comprises passing a char product of fluidizable particle size comprising carbonaceous material and metal deposits which will promote the formation of CO obtained at an elevated temperature to a fluidized char particle carbon monoxide generation zone in admixture with preheated carbon dioxide wherein the primary source of endothermic reaction heat to form CO is supplied by said fluid char particles and said preheated carbon dioxide;

maintaining the metal deposit on said char particles in a reducing state by the presence of high CO concentration;

separating a product of said CO generation zone into a carbon monoxide rich stream and an unreacted carbon dioxide rich stream;

recovering a portion of the carbon monoxide thus produced as a product of the process;

passing another separated portion of said produced carbon monoxide in admixture with steam to catalytic water gas shift reaction zone maintained under conditions to produce hydrogen and carbon dioxide;

separating a hydrogen rich stream from a carbon dioxide rich stream produced in said shift reaction zone;

recycling carbon dioxide product of said shift reaction zone admixed with $CO_2$ separated from the CO product of said CO generator zone through indirect heating zones to heat the mixed $CO_2$ stream to an elevated temperature before passing said fluid char particle to the CO generation zone;

separating unreacted fluid char particles from said CO generation zone;

and passing the separated fluid char particles to a heating zone to maintain the heat of said particles at elevated temperature.

2. The method of claim 1 wherein the char product passed to said CO generation zone comprises fluidizable particles of coke at an elevated temperature obtained from either one or both of a fluid coking operation or a fluid coke partial burning operation.

3. The method of claim 2 wherein a liquid product of fluid coking, either with or without hydrogenation thereof is used as a solvent for coal in a coal solubilization operation and a solubilized coal product comprising coal particles is thereafter passed to a fluid coking operation in admixture with hot coke particles obtained from a fluid coke partial burning operation.

4. The method of claim 1 wherein the reaction of carbon dioxide with carbonaceous particle material is accomplished in the presence of adding oxygen to the reaction.

* * * * *